US008337144B2

(12) United States Patent
Stabley et al.

(10) Patent No.: US 8,337,144 B2
(45) **Date of Patent: *Dec. 25, 2012**

(54) METHOD FOR DETECTING ROTATING STALL IN A COMPRESSOR

(75) Inventors: Robert E. Stabley, Dallastown, PA (US); E. Curtis Eichelberger, Harrisburg, PA (US)

(73) Assignee: Johnson Controls Technology Company, Holland, MI (US)

( * ) Notice: Subject to any disclaimer, the term of this patent is extended or adjusted under 35 U.S.C. 154(b) by 26 days.

This patent is subject to a terminal disclaimer.

(21) Appl. No.: 12/960,024

(22) Filed: Dec. 3, 2010

(65) Prior Publication Data

US 2011/0076131 A1 Mar. 31, 2011

Related U.S. Application Data

(63) Continuation of application No. 11/690,222, filed on Mar. 23, 2007, now Pat. No. 7,905,702.

(51) Int. Cl.
*F01D 25/04* (2006.01)

(52) U.S. Cl. ..... 415/118; 415/1; 415/914

(58) Field of Classification Search ..... 415/1, 13, 415/26, 118, 914

See application file for complete search history.

(56) References Cited

U.S. PATENT DOCUMENTS

| | | | | |
|---|---|---|---|---|
| 3,935,558 | A | 1/1976 | Miller et al. | |
| 5,533,383 | A | 7/1996 | Greene et al. | |
| 5,714,687 | A * | 2/1998 | Dunegan | 73/587 |
| 5,767,780 | A | 6/1998 | Smith et al. | |
| 6,010,303 | A * | 1/2000 | Feulner | 415/118 |
| 6,036,432 | A | 3/2000 | Shistla et al. | |
| 6,857,845 | B2 * | 2/2005 | Stabley et al. | 415/1 |
| 7,905,702 | B2 * | 3/2011 | Stabley et al. | 415/118 |
| 2004/0037693 | A1 | 2/2004 | Stabley et al. | |

* cited by examiner

*Primary Examiner* — Edward Look
*Assistant Examiner* — Ryan Ellis
(74) *Attorney, Agent, or Firm* — McNees Wallace & Nurick LLC

(57) ABSTRACT

A system and method is provided for detecting and controlling rotating stall in the diffuser region of a compressor. A pressure transducer is placed in the gas flow path downstream of the impeller, preferably in the compressor discharge passage or the diffuser, to measure the sound or acoustic pressure phenomenon. Next, the signal from the pressure transducer is processed either using analog or digital techniques to determine the presence of rotating stall. Rotating stall is detected by comparing the detected energy amount, which detected energy amount is based on the measured acoustic pressure, with a predetermined threshold amount corresponding to the presence of rotating stall. Finally, an appropriate corrective action is taken to change the operation of the compressor in response to the detection of rotating stall.

31 Claims, 9 Drawing Sheets

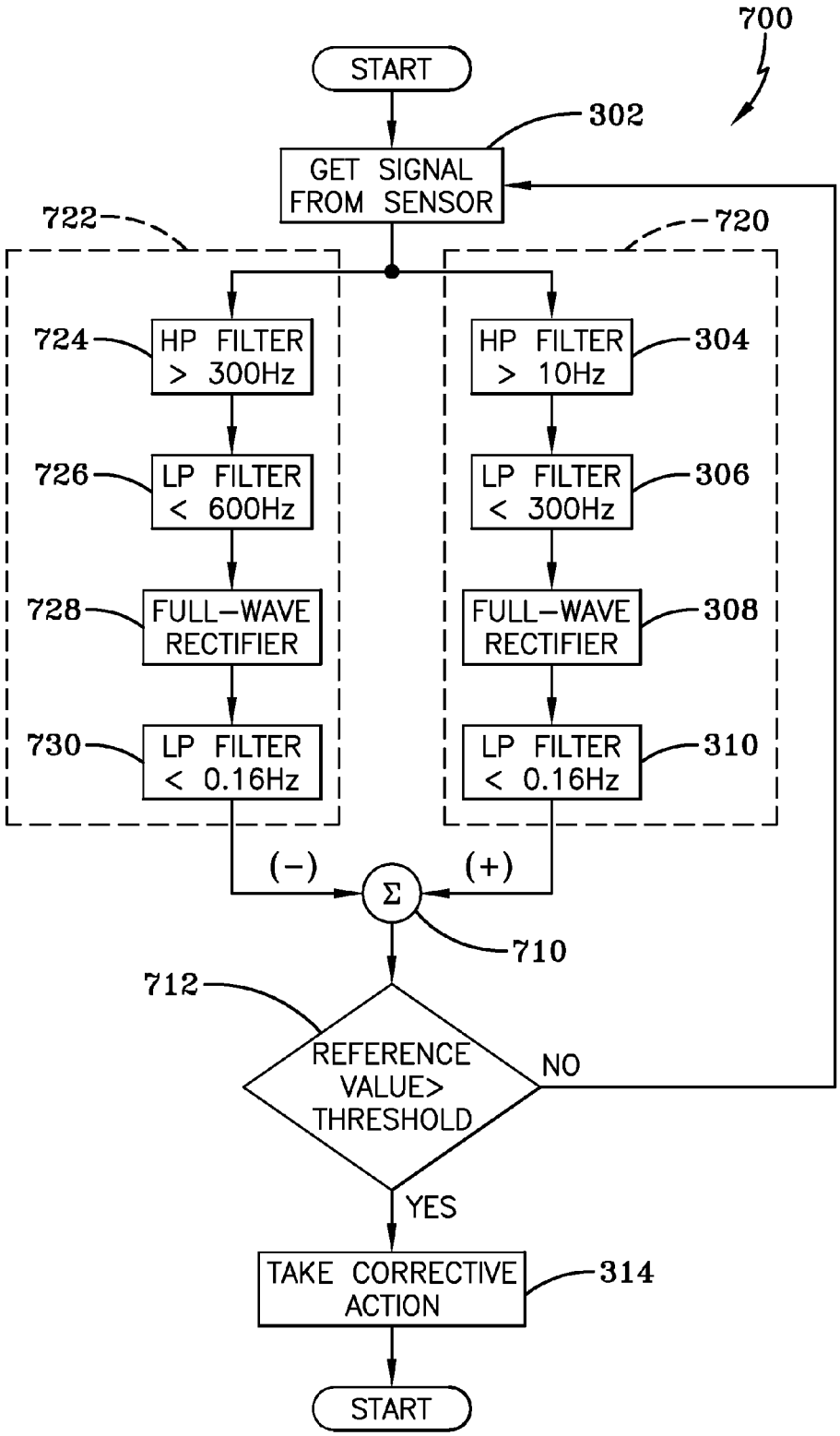
FIG−7

METHOD FOR DETECTING ROTATING STALL IN A COMPRESSOR

CROSS-REFERENCE TO RELATED APPLICATIONS

This application is a continuation of U.S. patent application Ser. No. 11/690,222 filed Mar. 23, 2007, entitled "METHOD FOR DETECTING ROTATING STALL IN A COMPRESSOR", which is hereby incorporated by reference.

BACKGROUND

The application generally relates to the detection of rotating stall in a compressor. More specifically, the application relates to systems and methods of detecting rotating stall in the diffuser portion of a compressor by sensing acoustic energy changes in the discharge from the compressor.

Rotating stall in a compressor can occur in the rotating impeller or rotor of the compressor or in the stationary diffuser of the compressor downstream from the impeller. The frequencies of the energy associated with rotating stall are typically within a common range of values whether the rotating stall is occurring in the impeller region (impeller rotating stall) or in the diffuser region (diffuser rotating stall). In both cases, the presence of rotating stall can adversely affect performance of the compressor and/or system. However, impeller rotating stall is typically of greater interest because it can affect impeller reliability, especially in axial flow compressors such as aircraft engines, while diffuser rotating stall typically impacts the overall sound and vibration levels of a system.

Some techniques for detecting and correcting impeller rotating stall use a plurality of sensors circumferentially positioned adjacent to the rotating impeller. The sensors are used to detect disturbances at individual locations. The disturbances are then compared to values at other locations or values corresponding to optimal operating conditions. Often, very complicated computations are performed to determine precursors to the onset of impeller rotating stall. Once impeller rotating stall is detected, some corrective actions include bleeding discharge gas back to the suction inlet of the compressor or modifying suction inlet flow angles using baffles or varying the position of the vanes.

One example of a technique for detecting impeller rotating stall in an axial flow compressor is in U.S. Pat. No. 6,010,303 (the '303 patent). The '303 patent is directed to the prediction of aerodynamic and aeromechanical instabilities in turbofan engines. An instability precursor signal is generated in real-time to predict engine surge, stall or blade flutter in aeropropulsion compression systems for turbofan engines which utilize multistage axial flow compressors. Energy waves associated with aerodynamic or aeromechanical resonances in a compression system for a turbofan engine are detected and a signal indicative of the frequencies of resonance is generated. Static pressure transducers or strain gauges are mounted near or on the fan blades to detect the energy of the system. The real-time signal is band pass filtered within a predetermined range of frequencies associated with an instability of interest, e.g. 250-310 Hz. The band pass signal is then squared in magnitude. The squared signal is then low pass filtered to form an energy instability precursor signal. The low pass filter provides an average of the sum of the squares of each frequency. The precursor signal is then used to predict and prevent aerodynamic and aeromechanical instability from occurring in a turbofan engine. One drawback of this technique is that it is only for the detection of impeller rotating stall in an axial flow compressor and does not discuss diffuser rotating stall.

Mixed flow compressors with vaneless radial diffusers can experience diffuser rotating stall during some part, or in some cases, all of their intended operating range. Typically, diffuser rotating stall occurs because the design of the diffuser is unable to accommodate all flows without some of the flow experiencing separation in the diffuser passageway. Diffuser rotating stall results in the creation of low frequency sound energy or pulsations in the gas flow passages at fundamental frequencies that are generally less than the rotating frequency of the compressor's impeller. This low frequency sound energy and its associated harmonics propagate downstream through the compressor gas passageways into pipes, heat exchangers and other vessels. The low frequency sound energy or acoustic disturbances can have high magnitudes and are undesirable because the presence of acoustic disturbances may result in the premature failure of the compressor, its controls, or other associated parts/systems.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

The present application can use either analog or digital circuits (or a combination of the two) to detect the presence of rotating stall in the diffuser. The circuits process a signal from a pressure transducer located in the diffuser or downstream from the diffuser using a high pass filter with a break frequency of about 10 Hz to be able to analyze the AC (or dynamic) fluctuations from the pressure transducer. Next, a low pass filter is used to attenuate frequencies above a break frequency of about 300 Hz. The operation of the low pass and the high pass filter can be considered to be similar to a band pass filter with a bandwidth of about 10 to about 300 Hz. The 10-300 Hz range is important because AC components in this range increase in amplitude as the operation of the compressor moves into rotating stall. At the same time, the signal is processed in the same manner to isolate a second frequency band from about 300 to about 600 Hz, i.e., the high pass filter has a break frequency of 300 Hz and the low pass filter has a break frequency of 600 Hz. The energy in the second frequency band that is adjacent to the first frequency band, the energy does not increase as fast as the energy in the first frequency band when stall conditions are present.

One embodiment is directed to a method for correcting rotating stall in a radial diffuser of a compressor. The method includes the steps of measuring a value representative of acoustical energy associated with rotating stall in a radial diffuser of a compressor, filtering the measured value with a first filter to obtain a first filtered value corresponding to a first stall frequency range, and rectifying the first filtered value with a first rectifier to obtain a first rectified value. The method further includes filtering the first rectified value to obtain a first stall energy component, filtering the measured value with a second filter to obtain a second filtered value corresponding to a second stall frequency range, and rectifying the second filtered value with a second rectifier to obtain a second rectified value, filtering the second rectified value with a filter to obtain a second stall energy component, subtracting the second stall energy component from the first stall energy component to obtain a differential stall energy component; comparing the differential stall energy component to a predetermined threshold value to determine rotating stall in the compressor; and sending a control signal to adjust an operational configuration of the compressor in response to a determination of rotating stall.

Another embodiment is directed to a method for detecting rotating stall in a compressor. The method includes the steps of measuring a value representative of acoustical energy associated with rotating stall in a compressor, performing a Fast Fourier Transform on the measured value to obtain a plurality of frequencies and corresponding energy values, and selecting a primary band of frequencies and corresponding energy values associated with rotating stall from the plurality of frequencies and energy values. The method further includes the steps of summing the corresponding energy values from the primary band of frequencies associated with rotating stall to obtain a primary rotating stall parameter, selecting a secondary band of frequencies and corresponding energy values associated with rotating stall from the plurality of frequencies and energy values, and summing the corresponding energy values from the secondary band of selected frequencies associated with rotating stall to obtain a secondary rotating stall parameter. Finally, the method further includes the steps of calculating a differential rotating stall parameter from the secondary rotating stall parameter and the primary rotating stall parameter, and detecting rotating stall in the compressor by comparing the differential rotating stall parameter to a predetermined threshold value.

Still another embodiment is directed to a system for correcting rotating stall in a radial diffuser of a compressor. The system includes a sensor configured to measure a parameter representative of acoustical energy associated with rotating stall in a radial diffuser of a compressor and generate a sensor signal corresponding to the measured parameter. The system also includes a first analog circuit. The first analog circuit includes a first bandpass filter configured to receive the sensor signal and output a first bandpass filtered signal. A full wave rectifier is configured to receive the first band pass filtered signal and output a first rectified signal, and a low pass filter is configured to receive the first rectified signal and output a primary stall energy component signal. The system also includes a second analog circuit. The second analog circuit includes a second bandpass filter configured to receive the sensor signal and output a second bandpass filtered signal. A full wave rectifier is configured to receive the second bandpass filtered signal and output a second rectified signal. A second low pass filter is configured to receive the second rectified signal and output a secondary stall energy component signal. The system also includes control circuitry configured to determine a differential stall energy component from the secondary stall energy component and the primary stall energy component, compare the differential stall energy component to a predetermined value, and output a control signal to adjust an operational configuration of the compressor in response to a determination of rotating stall.

A further embodiment is directed to a system for correcting rotating stall in a radial diffuser of a compressor. The system includes a sensor configured to measure a parameter representative of acoustical energy associated with rotating stall in a radial diffuser of a compressor and generate a sensor signal corresponding to the measured parameter, and an analog to digital converter to convert the sensor signal to a digital signal. A pair of digital processors is configured so that each receives the digital signal from the digital to analog converter. The first digital signal processor includes a high pass filter having a break frequency of about 10 Hz, and configured to receive the digital signal and output a high pass filtered signal. The first digital signal processor also includes a low pass filter having a break frequency of about 300 Hz. The low pass filter is configured to receive the first high pass filtered signal from the first high pass filter and output a low pass filtered signal. A full wave rectifier is provided in the first analog circuit, and is configured to receive the first low pass filtered signal and output a first rectified signal. A second low pass filter is configured to receive the first rectified signal and output a primary stall energy component signal. The second digital processor includes a high pass filter having a break frequency of about 300 Hz, and is configured to receive the digital signal and output a second high pass filtered signal. The system also includes a third low pass filter with a break frequency of about 600 Hz. The third low pass filter receives the second high pass filtered signal from the second high pass filter and outputs a second low pass filtered signal. A second full wave rectifier is configured to receive the second low pass filtered signal and output a second rectified signal to a fourth low pass filter that is configured to receive the second rectified signal and output a secondary stall energy component signal. Control circuitry is configured to subtract the secondary stall energy component from the primary stall energy component to determine rotating stall in the radial diffuser and output a digital control signal. A digital to analog converter converts the digital control signal component signal to an analog signal to adjust an operational configuration of the compressor in response to a determination of rotating stall.

Certain advantages of the embodiments described herein are as follows:

One advantage is that a simplified package of electronics and hardware is used to detect rotating stall in the diffuser portion of the compressor.

Another advantage is that the method of subtracting energy from frequency band signals in two frequency ranges and subtracting the higher band from the lower band helps to avoid unwanted variable geometry diffuser (VGD) closure at lower compressor speeds, where stall at the impeller inlet can be high enough to initiate unwanted VGD closure.

Another advantage is an enhanced stall detection scheme that makes the operation of the VGD control much more robust, since the control system is less likely to be confused by a non-stall related increase in energy at low frequency.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which:

FIG. 7 illustrates a flow chart for detecting and correcting a rotating stall condition in an alternate embodiment.

DETAILED DESCRIPTION OF THE EXEMPLARY EMBODIMENTS

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
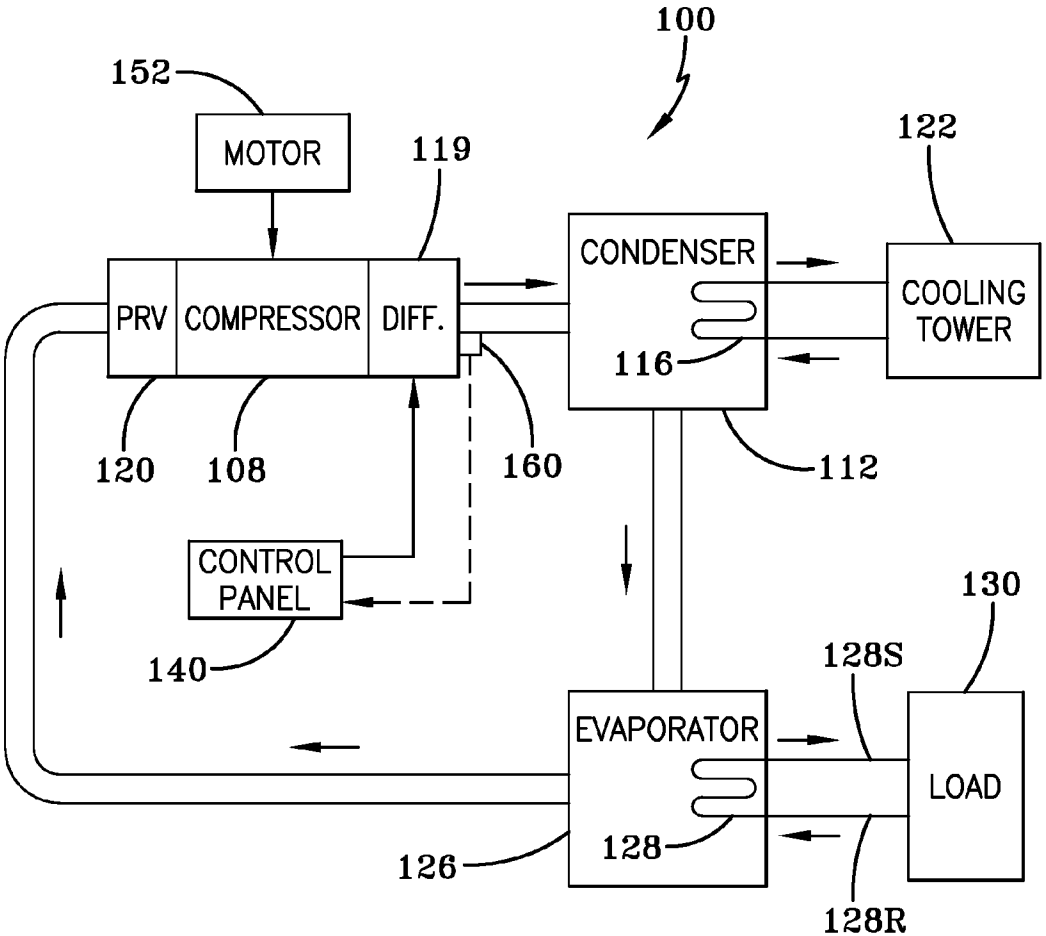
FIG. 1 illustrates schematically a refrigeration system.

A general system to which the invention can be applied is illustrated, by means of example, in FIG. 1. As shown, the HVAC, refrigeration or liquid chiller system 100 includes a compressor 108, a condenser 112, a water chiller or evaporator 126, and a control panel 140. The control panel 140 receives input signals from the system 100 that indicate the performance of the system 100 and transmits signals to components of the system 100 to control the operation of the system 100. The conventional liquid chiller system 100 includes many other features that are not shown in FIG. 1. These features have been purposely omitted to simplify the drawing for ease of illustration.

Compressor 108 compresses a refrigerant vapor and delivers the vapor to the condenser 112 through a discharge line. The compressor 108 can be a compressor; however, any type of compressor that can experience a rotating stall condition or operate at a flow where rotating stall can occur can be used. The refrigerant vapor delivered to the condenser 112 enters into a heat exchange relationship with a fluid, e.g. air or water, and undergoes a phase change to a refrigerant liquid as a result of the heat exchange relationship with the fluid. The condensed liquid refrigerant from condenser 112 flows to an evaporator 126. In one embodiment, the refrigerant vapor in the condenser 112 enters into the heat exchange relationship with water, flowing through a heat-exchanger coil 116 connected to a cooling tower 122. The refrigerant vapor in the condenser 112 undergoes a phase change to a refrigerant liquid as a result of the heat exchange relationship with the water in the heat-exchanger coil 116.

The evaporator 126 can include a heat-exchanger coil 128 having a supply line 128S and a return line 128R connected to a cooling load 130. The heat-exchanger coil 128 can include a plurality of tube bundles within the evaporator 126. A secondary liquid, which can be water, but can be any other suitable secondary liquid, e.g., ethylene glycol, calcium chloride brine or sodium chloride brine, travels into the evaporator 126 via return line 128R and exits the evaporator 126 via supply line 128S. The liquid refrigerant in the evaporator 126 enters into a heat exchange relationship with the secondary liquid in the heat-exchanger coil 128 to chill the temperature of the secondary liquid in the heat-exchanger coil 128. The refrigerant liquid in the evaporator 126 undergoes a phase change to a refrigerant vapor as a result of the heat exchange relationship with the secondary liquid in the heat-exchanger coil 128. The vapor refrigerant in the evaporator 126 exits the evaporator 126 and returns to the compressor 108 by a suction line to complete the cycle. While the system 100 has been described in terms of some embodiments for the condenser 112 and evaporator 126, it is to be understood that any suitable configuration of condenser 112 and evaporator 126 can be used in system 100, provided that the appropriate phase change of the refrigerant in the condenser 112 and evaporator 126 is obtained.

At the input or inlet to the compressor 108 from the evaporator 126, there are one or more pre-rotation vanes or inlet guide vanes 120 that control the flow of refrigerant to the compressor 108. An actuator is used to open the pre-rotation vanes 120 to increase the amount of refrigerant to the compressor 108 and thereby increase the cooling capacity of the system 100. Similarly, an actuator is used to close the pre-rotation vanes 120 to decrease the amount of refrigerant to the compressor 108 and thereby decrease the cooling capacity of the system 100.

To drive the compressor 108, the system 100 includes a motor or drive mechanism 152 for compressor 108. While the term "motor" is used with respect to the drive mechanism for the compressor 108, it is to be understood that the term "motor" is not limited to a motor but is intended to encompass any component that can be used in conjunction with the driving of motor 152, such as a variable speed drive and a motor starter. In one embodiment the motor or drive mechanism 152 is an electric motor and associated components. However, other drive mechanisms such as steam or gas turbines or engines and associated components can be used to drive the compressor 108.

Figure 2:
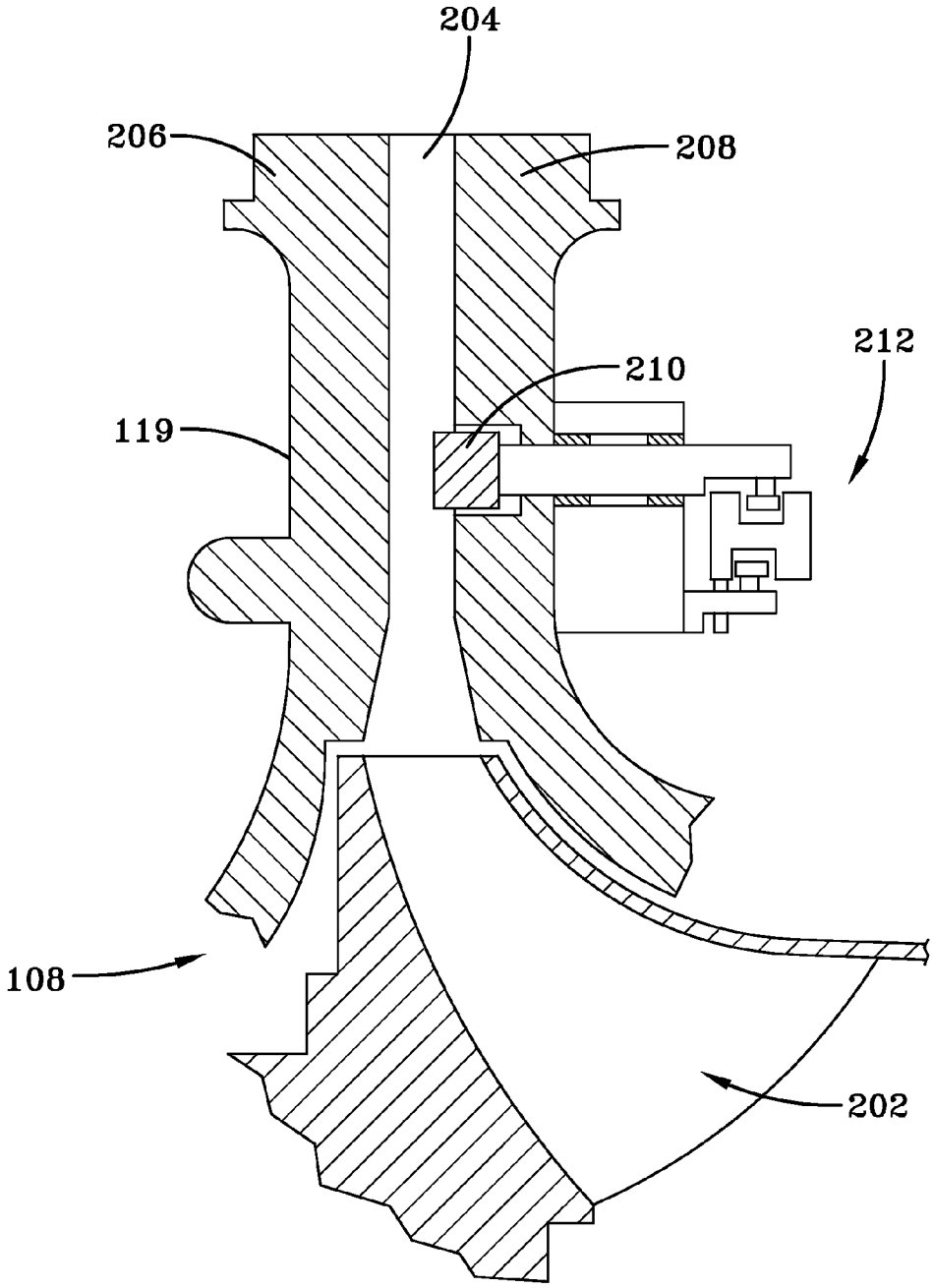
FIG. 2 illustrates a partial sectional view of a compressor and diffuser.

FIG. 2 illustrates a partial sectional view of the compressor 108 of one embodiment. The compressor 108 includes an impeller 202 for compressing the refrigerant vapor. The compressed vapor then passes through a diffuser 119. The diffuser 119 is preferably a vaneless radial diffuser and has a diffuser space 204 formed between a diffuser plate 206 and a nozzle base plate 208 for the passage of the refrigerant vapor. The nozzle base plate 208 is configured for use with a diffuser ring 210. The diffuser ring 210 is used to control the velocity of refrigerant vapor that passes through the diffuser passage 202. The diffuser ring 210 can be extended into the diffuser passage 202 to increase the velocity of the vapor flowing through the passage and can be retracted from the diffuser passage 202 to decrease the velocity of the vapor flowing through the passage. The diffuser ring 210 can be extended and retracted using an adjustment mechanism 212.

Referring back to FIG. 1, the system 100 also includes a sensor 160 for sensing an operating condition of system 100 that can be used to determine a rotating stall condition in the diffuser 119. The sensor 160 can be placed anywhere in the gas flow path downstream of the impeller 202 of the compressor 108. However, the sensor 160 can be positioned in the compressor discharge passage (as shown schematically in FIG. 1) or the diffuser 119. The sensor 160 can be a pressure transducer for measuring an acoustic or sound pressure phenomenon, however, other types of sensors may also be employed. For example, an accelerometer can be used to measure stall related vibration. The pressure transducer generates a signal that is representative of the stall energies present in the discharge line. The signal from the sensor 160 is transferred over a line to the control panel 140 for subsequent processing to determine and correct rotating stall in the diffuser 119.

The output of sensor 160 used to measure the energy associated with rotating stall can be conditioned so as to differentiate between stall-related acoustic energy and energy due to other sources of sound or vibration. In one embodiment, the conditioning can occur by simply measuring the amount of energy within a range of frequencies that includes the fundamental stall frequency and its major harmonics. In other conditioning schemes, some frequencies within the stall-related region that are not related to stall could be sensed and removed from the analysis in order to enhance the ability to detect the presence of only rotating stall energies. The conditioned output signal from sensor 160 can be used in conjunction with the process discussed below to take corrective action to avoid significant amounts of rotating stall noise being generated by the compressor 108.

The strength and frequency content of the sound energy associated with rotating stall has been studied extensively. As the operation of a compressor moves into the rotating stall region, there is an increase, within a predetermined frequency band of approximately 10-300 Hz, of the AC components of the sound energy. It has also been observed that the onset of significant amounts of rotating stall is rather abrupt. Thus, a frequency analysis of a signal representative of the sound energy present in the gas flow shows that a sudden increase in the strength or magnitude of the stall related energies in the 10-300 Hz frequency band is indicative of the compressor moving into a rotating stall condition.

Figure 3:
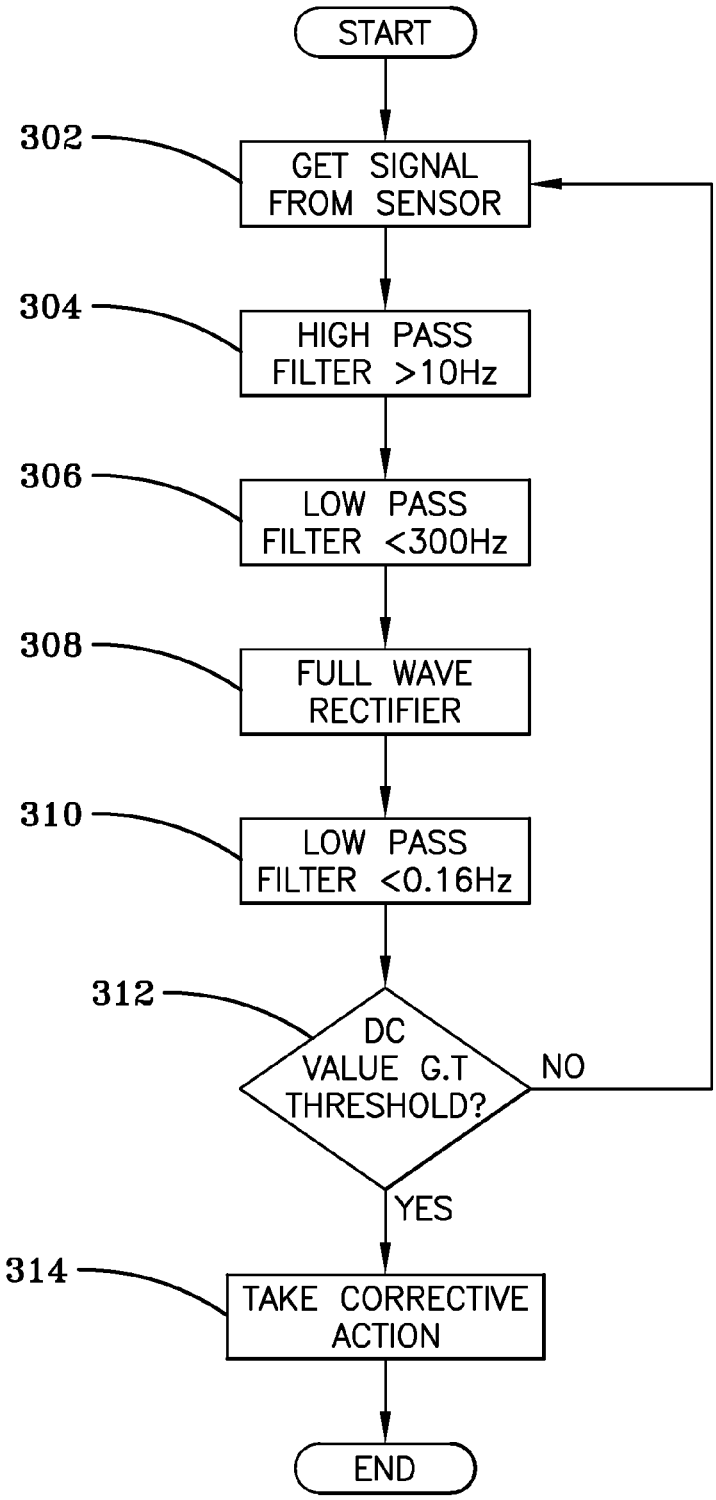
FIG. 3 illustrates a flow chart for detecting and correcting a rotating stall condition in one embodiment.

FIG. 3 illustrates one process for detecting and correcting rotating stall in the diffuser 119 of the compressor 108. The process can be implemented on the control panel 140 using analog components (a portion of which is shown schematically in FIG. 4), digital components (a portion of which is shown schematically in FIG. 5) or a combination of analog and digital components (not shown). The process begins at step 302 with the control panel 140 receiving a signal from sensor 160. As discussed above, the signal received from sensor 160 corresponds to an amount of energy which may indicate the onset of rotating stall. The direct measurement of the sound pressure phenomenon with the pressure transducer 160 in the embodiment provides a more reliable indication of the existence of rotating stall and avoids other, non-stall related acoustic signals. For example, if the vibration of the compressor 108 is used to detect the onset of rotating stall, any vibration due to the unbalance of the compressor's motor 152, or gear, or impeller 202 which may be in the same frequency range as the rotating stall noise can provide signals of such magnitudes that they may interfere with the ability to detect only the rotating stall noise related components.

In step 304, the signal from sensor 160 is passed through a high pass filter. In determining the presence of rotating stall, the AC fluctuations from sensor 160 represent the signal of interest and the DC portion of the signal is not required for the detection of rotating stall. Therefore, the high pass filter is used to remove the DC portion of the signal. The high pass filter can have a break frequency of about 10 Hz. The break frequency can be set to any appropriate value that removes the DC portion of the signal while leaving a sufficient AC portion of the signal for analysis depending the desired accuracy of the detection. In one embodiment, the high pass filter can include a single pole RC high pass filter which results in an input signal attenuation of 0.707 at 10 Hz which decreases below this frequency to zero at DC (0 Hertz). In other embodiments, higher order high pass filters can be used for filtering the signal from the sensor 160.

After passing through the high pass filter and a gain amplifier (if necessary), the signal is then passed through a low pass filter in step 306. The low pass filter is used to attenuate frequencies above a break or cutoff frequency, which break frequency defines the upper frequency level associated with rotating stall conditions. In one embodiment, the upper frequency or break frequency associated with rotating stall energy is about 300 Hz. In one embodiment, a six order Butterworth low pass filter is used to eliminate frequency components above the stall frequency range (approximately 10-300 Hz) not related to rotating stall which could result in a false indication of rotating stall. In other embodiments, different order, possibly larger order, low pass filters can be used to remove the higher frequencies.

In another embodiment, steps 304 and 306 can be combined into a single step. In this embodiment, instead of using both a high pass filter (step 304) and a low pass filter (step 306), a band pass filter can be used to remove both the DC component and the higher frequencies from the sensor signal. The band pass filter can have a frequency range of about 10-300 Hz, which is the equivalent frequency range after the high pass and low pass filters of steps 304 and 306.

After passing through the low pass filter in step 306, the signal is passed through an active full wave rectifier in step 308. The active full wave rectifier is used to convert or "flip" the negative portions of the AC signal to an equivalent positive value while having no impact on the positive portion of the AC signal. The full wave rectified signal has only positive components and includes a composite of AC components superimposed on DC components. The composite signal yields an average (or DC) value which increases in magnitude as the energies at the stall frequencies increase in amplitude.

In step 310, the signal from the active full wave rectifier is passed through a low pass filter having a low cutoff frequency to pass only the DC component. As discussed above, the DC component portion of the full wave rectified waveform provides a representation of the stall fluctuation amplitude of the sensor 160, thus only the DC component of the signal is necessary for the detection of rotating stall. In one embodiment, the low pass filter can have a cutoff frequency of 0.16 Hz. However, this frequency is not critical and other cutoff frequencies, e.g., 0.1 Hz, can be used for passing only the DC component.

Figure 4:
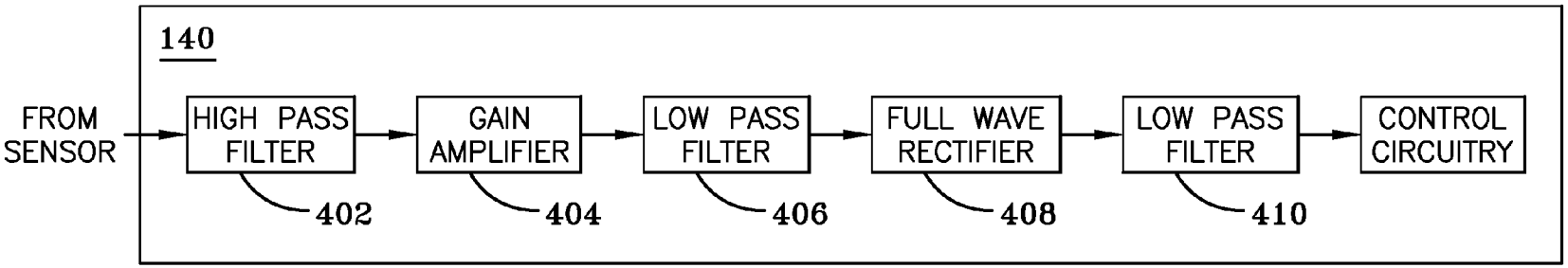
FIG. 4 illustrates schematically one embodiment of an analog circuit to detect rotating stall.

FIG. 4 illustrates schematically an analog circuit for completing steps 304-310. A high pass filter 402 receives the signal from sensor 160, which high pass filter 402 filters the signal as described with regard to step 304. If necessary, a gain amplifier 404 can be used to boost or strengthen the output from the high pass filter 402. The gain amplifier 404 can be used to boost the signal from the high pass filter 402 to an appropriate value for comparison to a threshold value representative of a rotating stall condition. A low pass filter 406 receives a signal from the gain amplifier 404 or the high pass filter 402 and filters the signal as described above with regard to step 306. An active full wave rectifier 408 is used to rectify the signal from the low pass filter 406 as described above with regard to step 308. An active full wave rectifier 408 is preferred in order to eliminate DC offsets that may be created by using a full wave bridge rectifier. Finally, the full wave rectified signal from the active full wave rectifier 408 is filtered using a low pass filter 410, which filters the signal as described above with regard to step 310 and sends a signal to control circuitry, which control circuitry may include a microprocessor and/or comparator, for subsequent processing of the signal from the low pass filter 410.

Figure 5:
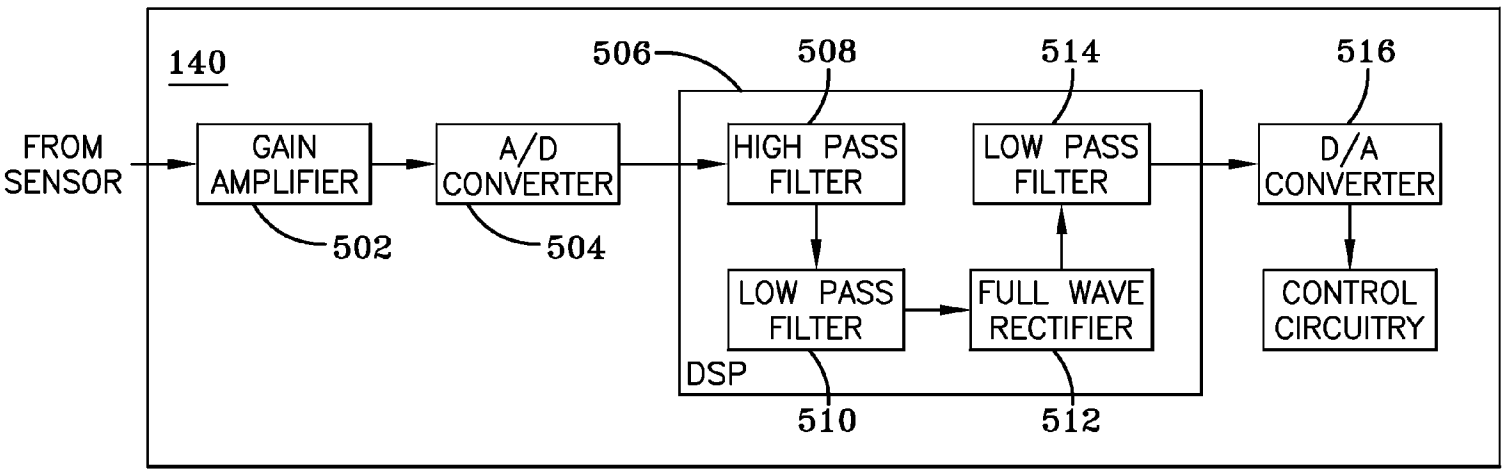
FIG. 5 illustrates schematically one embodiment of a digital circuit to detect rotating stall.

FIG. 5 illustrates schematically a digital circuit for completing steps 304-310. If necessary, a gain amplifier 502 can be used to boost or strengthen the signal from sensor 160 to an appropriate value for comparison to a threshold value representative of a rotating stall condition. The signal from gain amplifier 502 or the sensor 160 is then passed through an A/D converter 504 to convert the analog signal to a digital signal. The digital signal from the A/D converter 504 is then preferably provided to digital signal processor (DSP) circuitry 506 for completing steps 304-310. In DSP circuitry 506, a high pass filter 508 receives the signal from A/D converter 504, which high pass filter 508 filters the signal as described with regard to step 304. A low pass filter 510 receives a signal from the high pass filter 508 and filters the signal as described with regard to step 306. A full wave rectifier 512 is used to rectify the signal from the low pass filter 510 as described with regard to step 308. The full wave rectified signal from the full wave rectifier 512 is filtered using a low pass filter 514, which filters the signal as described with regard to step 310. Finally, the signal from the low pass filter 514 of DSP circuitry 506 is then passed through a D/A converter 516, which generates an analog signal and sends the analog signal to control circuitry, which may include a microprocessor and/or comparator, for subsequent processing of the analog signal.

Referring back to FIG. 3, the low pass filtered signal having only a DC component from step 310 is then compared with a threshold value to determine the presence of rotating stall in step 312. As discussed above, the amplitude of the DC component increases as the compressor 108 moves into a rotating stall condition. Thus, the presence of rotating stall can be detected by determining when the DC component or voltage exceeds a threshold value. The threshold value can be set to a value equal to a multiple of the normal operating value for the DC component, i.e., the value of the DC component when there is no rotating stall. In one embodiment, the threshold value can be two to six times the normal operating value. For example, if the normal operating values for the DC component are 0.2-0.4 VDC, then the threshold values for detecting rotating stall can be between 0.8-1.2 VDC. The values for normal operation and threshold are dependent on the amount of gain that is applied to the signal. In other words, when more gain that is applied to a signal, the normal operating value will be larger and the threshold value will be larger. If rotating stall is not detected in step 312, the process returns to step 302 and a new signal from sensor 160 is obtained for processing.

If rotating stall is detected in step 312, then corrective action is taken to correct the rotating stall condition in step 314. Corrective action can include, but is not limited to, narrowing the width of the diffuser space 204 of the radial diffuser 119, shortening the length of the radial diffuser 119, or increasing flow to the compressor 108 at the compressor inlet or downstream of the impeller 202. In one embodiment, upon the detection of rotating stall the control panel 140 sends a signal to the diffuser 119 and specifically, adjustment mechanism 212 of the diffuser 119 to adjust the position of the diffuser ring 210 to correct the rotating stall condition. The diffuser ring 210 is inserted into the diffuser space 204 to narrow the width of the diffuser space 204 in order to correct the rotating stall condition.

Figure 6:
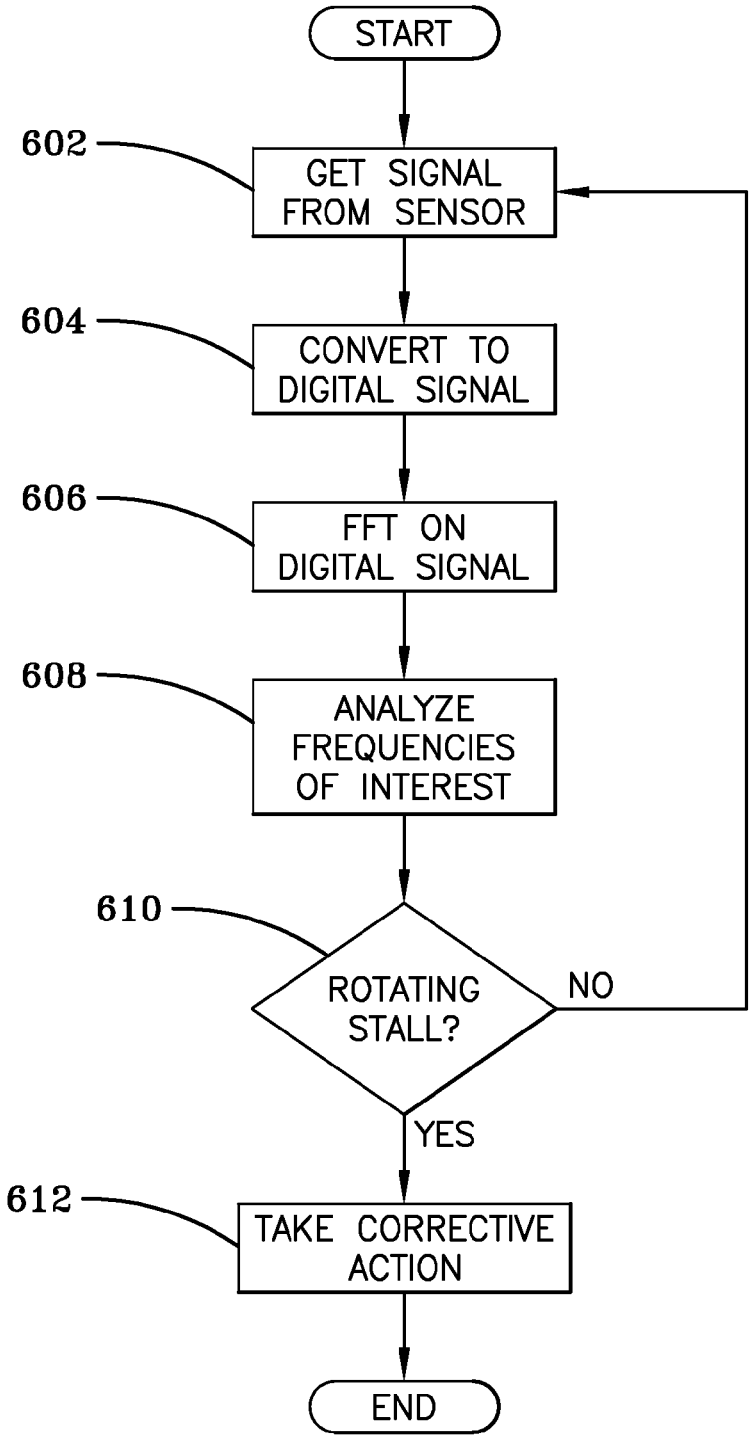
FIG. 6 illustrates a flow chart for detecting and correcting a rotating stall condition in another embodiment.

In another embodiment, a Fast Fourier Transform (FFT) can be used to detect the presence of rotating stall. FIG. 6 illustrates one process for detecting and correcting rotating stall in the diffuser 119 of the compressor 108 using an FFT. The process begins with the control panel 140 receiving a signal from sensor 160 in step 602 and converting the signal from sensor 160 into a digital signal in step 604 preferably using an A/D converter. Next, in step 606, a FFT is applied to the digital signal from step 604 to generate a plurality of frequencies and energy values. The FFT is programmed into a DSP chip on the control panel 140 and can be executed in real time. The FFT DSP chip can be configured to perform any necessary operations or calculations such as multiplies and accumulations to complete the FFT. The application of an FFT to the digitized input signal from sensor 160 permits rotating stall to be detected directly in the frequency domain rather than in the time domain as described above with regard to FIG. 3.

Since only a particular range of fundamental frequencies are of interest in the detection of rotating stall, approximately 10-300 Hz as discussed in greater detail above, only those particular frequencies of interest have to be analyzed in the frequency domain in step 608, i.e. the frequencies not associated with rotating stall can be discarded. Further, the particular range of fundamental frequencies of interest are always equal to or below the rotating frequency of the compressor's impeller 202, thus, the analysis of rotating stall can be limited to an appropriate range of interest by considering the compressor's speed. This limitation on the frequency range of interest is beneficial in variable speed drive (VSD) applications, since as the speed of the impeller 202 is reduced, the frequency range of interest becomes narrower and thereby aids in the elimination of extraneous frequencies which would lead to a false detection. Whether or not the compressor is operated in variable speed or fixed speed, frequency components in the FFT associated with rotating stall and its harmonics are kept, while frequency components related to the operating speed of the impeller and its harmonics are removed (set to zero). Also, other non-stall frequencies below the rotating frequency of the compressor's impeller 202 such as electrical interference (60 Hz and harmonics), which may couple through the transducer, are also removed.

After the elimination of extraneous frequencies in step 608, the remaining components or frequencies from the FFT are then summed to determine if the resulting value is within the stall region in step 610. Similar to the detection of rotating stall in step 312, the detection of rotating stall in step 610 is based on the summed or resulting value being greater than a threshold value that defines the stall region. The threshold value can be set to a value equal to a multiple of the normal operating value for the summed or resulting value from the FFT components, i.e. the value of the summed or resulting value from the FFT components when there is no rotating stall. In one embodiment, the threshold value can be two to six times the normal operating value. The values for normal operation and threshold are dependent on the strength of the signal that is analyzed and on the amount of amplification that is applied to the signal to enhance signal to noise ratios. In another embodiment, rotating stall can be detected by determining if peaks in the remaining frequency spectrum exceed a pre-determined threshold value. If rotating stall is not detected in step 610, the process returns to step 602 and a new signal from sensor 160 is obtained for processing.

If rotating stall is detected in step 610, then corrective action is taken to correct the rotating stall condition in step 612. Corrective action can include, but is not limited to, narrowing the width of the diffuser space 204 of the radial diffuser 119, shortening the length of the radial diffuser 119, or increasing flow to the compressor 108 at the compressor inlet or downstream of the impeller 202. In one embodiment, upon the detection of rotating stall the control panel 140 sends a signal to the adjustment mechanism 212 of the diffuser 119 to adjust the position of the diffuser ring 210 to correct the rotating stall condition. The diffuser ring 210 is inserted into the diffuser space 204 to narrow the width of the diffuser space 204 in order to correct the rotating stall condition.

Referring next to FIG. 7, there is illustrated another embodiment for detecting and correcting rotating stall in the diffuser 119 of the compressor 108. In this embodiment, the process can be implemented in the same manner as described with respect to FIG. 3 above, i.e., on the control panel 140 using analog components, digital components or a combination of analog and digital components. The process begins at step 302 with the control panel 140 receiving a signal from sensor 160. As discussed above, the signal received from sensor 160 corresponds to an amount of energy which may indicate the onset of rotating stall. The direct measurement of the sound pressure phenomenon with the pressure transducer 160 provides a more reliable indication of the existence of rotating stall and avoids other, non-stall related acoustic signals.

Following step 302, there are two processes that can be executed concurrently, as indicated by broken lines 720 and 722. The first process 720 includes the same steps, steps 304-310, described above for FIG. 3. Beginning with step 304, the signal from sensor 160 is passed through a high pass filter. The high pass filter is used to remove the DC portion of the signal that is not used. In one embodiment, the high pass filter has a break frequency of about 10 Hz, and the break frequency can be set to any appropriate value that removes the DC portion of the signal while leaving a sufficient AC portion of the signal for analysis depending the desired accuracy of the detection. In another embodiment, the high pass filter can include a single pole RC high pass filter which results in an input signal attenuation of 0.707 at 10 Hz which decreases below this frequency to zero at DC (0 Hertz). In other embodiments, higher order high pass filters can be used for filtering the signal from the sensor 160.

After passing through the high pass filter and a gain amplifier (if necessary), the signal is then passed through a low pass filter in step 306. The low pass filter is used to attenuate frequencies above a break or cutoff frequency. The break frequency defines the upper frequency level associated with rotating stall conditions. In one embodiment, the upper frequency or break frequency associated with rotating stall energy is about 300 Hz. In one embodiment, a 6th-order Butterworth low pass filter is used to eliminate frequency components above the stall frequency range (approximately 10-300 Hz) not related to rotating stall which could result in a false indication of rotating stall. In other embodiments, different, preferably larger order low pass filters can be used to remove the higher frequencies.

In another embodiment, steps 304 and 306 can be combined into a single step. In this embodiment, instead of using both a high pass filter (step 304) and a low pass filter (step 306), a band pass filter can be used to remove both the DC component and the higher frequencies from the sensor signal. The band pass filter preferably has a frequency range of about 10-300 Hz, which is the equivalent frequency range after the high pass and low pass filters of steps 304 and 306.

After passing through the low pass filter in step 306, the signal is passed through an active full wave rectifier in step 308. The active full wave rectifier is used to convert or "flip" the negative portions of the AC signal to an equivalent positive value while having no impact on the positive portion of the AC signal. The full wave rectified signal has only positive components and includes a composite of AC components superimposed on DC components. The composite signal yields an average (or DC) value which increases in magnitude as the energies at the stall frequencies increase in amplitude.

In step 310, the signal from the active full wave rectifier is passed through a low pass filter having a low cutoff frequency to pass only the DC component. As discussed above, the DC component portion of the full wave rectified waveform provides a representation of the stall fluctuation amplitude of the sensor 160, thus only the DC component of the signal is necessary for the detection of rotating stall. In one embodiment, the low pass filter can have a cutoff frequency of 0.16 Hz. However, this frequency is not critical and other cutoff frequencies, e.g., 0.1 Hz, can be used for passing only the DC component.

In the second process 722, the frequency band between 300 Hz and 600 Hz is of interest. Since lower frequencies increase much faster than higher frequencies when genuine stall conditions are present, using the difference between the energy in the lower frequency band and the energy in the higher frequency band keeps the reference signal high, and closure of the VGD is initiated. However, when broadband frequency levels occur, which are associated with high flow through the impeller at low head pressure conditions, the difference remains low and inappropriate closure is avoided.

As indicated above, the second process 722 is concurrently executed with the first process 720. In step 724, the signal from sensor 160 is passed through a high pass filter. For the same reasons as indicated with step 704, the AC fluctuations from sensor 160 represent the signal of interest and the DC portion of the signal is not required for the detection of rotating stall. Therefore, the high pass filter is used to remove the DC portion of the signal. The high pass filter in step 724 preferably has a break frequency of about 300 Hz. The break frequency can be set to any appropriate value that removes the DC portion of the signal while leaving a sufficient AC portion of the signal for analysis depending the desired accuracy of the detection. In one embodiment, the high pass filter can include a single pole RC high pass filter which results in an input signal attenuation of 0.707 at 300 Hz which decreases below this frequency to zero at DC (0 Hertz). In other embodiments, higher order high pass filters can be used for filtering the signal from the sensor 160.

After passing through the high pass filter and a gain amplifier (if necessary), the signal is then passed through a low pass filter in step 726. The low pass filter is used to attenuate frequencies above a secondary break or cutoff frequency, which secondary break frequency occurs at a frequency that is about two times that of the upper frequency level associated with rotating stall conditions, i.e., the upper frequency level of the first process 720. In one embodiment, the secondary break frequency is about 600 Hz. In one embodiment, a 6th order Butterworth low pass filter is used to eliminate frequency components above the secondary frequency range (approximately 300-600 Hz) that provides the energy to be subtracted from the lower frequency range associated with rotating stall. In other embodiments, different order, preferably larger order, low pass filters can be used to remove the higher frequencies.

In another embodiment, steps 724 and 726 can be combined into a single step. In this embodiment, instead of using both a high pass filter (step 724) and a low pass filter (step 726), a band pass filter can be used to remove both the DC component and the higher frequencies from the sensor signal. The band pass filter preferably has a frequency range of about 300-600 Hz, which is the equivalent frequency range after the high pass and low pass filters of steps 724 and 726.

After passing through the low pass filter in step 726, the signal is passed through an active full wave rectifier in step 728. The output of the active full wave rectifier yields an average (or DC) value which increases in magnitude as the energies at the secondary range frequencies increase in amplitude, as described above.

In step 730, the signal from the active full wave rectifier is passed through a low pass filter having a low cutoff frequency to pass only the DC component. As discussed above, the DC component portion of the full wave rectified waveform in step 730 provides a representation of the secondary frequency range amplitude of the sensor 160, thus only the DC component of the signal is necessary for use in the detection of rotating stall. In one embodiment, the low pass filter can have a cutoff frequency of 0.16 Hz. However, this frequency is not critical and other cutoff frequencies, e.g., 0.1 Hz, can be used for passing only the DC component.

In step 710, the signal output of the low pass filter in step 730 is subtracted from the output signal of the low pass filter in step 310, to yield a reference value that is slightly lower than the energy in the primary stall range between 10 Hz and 300 Hz. The output signal of the subtraction step 710 is then compared with a threshold value to determine the presence of rotating stall in step 712. As discussed above, the amplitude of the DC component increases as the compressor 108 moves into a rotating stall condition. Thus, the presence of rotating stall can be detected by determining when the DC component or voltage exceeds a threshold value. When real stall is present, the lower frequencies increase much faster than the higher ones. Thus, the DC energy component associated with the primary or stall frequency range rises and subtraction of the DC energy component does not significantly reduce the reference value. The reference value thus exceeds the threshold value and VGD closure is initiated. However, when broadband levels (which are distinct from stall) occur at high refrigerant flow rates and low compressor head pressure, the DC energy component associated with secondary frequency range rises proportionately with the DC energy component associated with the primary stall frequency range. Thus, subtraction of the secondary frequency range DC energy component from the primary stall frequency range DC energy component significantly reduces the reference value. By comparing a reference value that is the difference between 1) the energy of the primary stall frequency range and 2) the energy in the secondary frequency range, the reference value signal is kept low during non-stall related events, and VGD closure is avoided. VGD closure occurs, however, when the energy in the secondary frequency range remains low at the same time that the energy in the primary stall frequency range rises, which is a characteristic pattern indicating an actual stall condition. The solution set forth in FIG. 7 is advantageously deployed at low compressor speeds, where a stall condition at the impeller inlet can be high enough to initiate unwanted VGD closure. The solution is not applicable to impeller stall but it may help to avoid VGD closure, because impeller stall is typically not as high as diffuser stall, and by subtracting the energy in the secondary frequency range the difference between the energy in the primary frequency range and the secondary frequency range is less likely to exceed the threshold level.

The threshold value can be set to a value equal to a multiple of the normal operating value for the reference value, i.e., the value of the difference taken at step 710, between values 310 and 730, when there is no rotating stall. In one embodiment, the threshold value can be two to six times the normal reference value. As discussed above, if the normal reference values for the DC component are in a range of 0.2-0.4 VDC, then the threshold values for detecting rotating stall can be between 0.8-1.2 VDC. The values for normal operation and threshold are dependent on the amount of gain that is applied to the signal. In other words, when more gain is applied to a signal, the normal operating value will be larger and the threshold value will be larger. If rotating stall is not detected in step 712, the process returns to step 302 and a new signal from sensor 160 is obtained for processing. If rotating stall is detected in step 312, then corrective action is taken to correct the rotating stall condition in step 314. Corrective action options are discussed above with respect to FIG. 3.

Figure 4A:
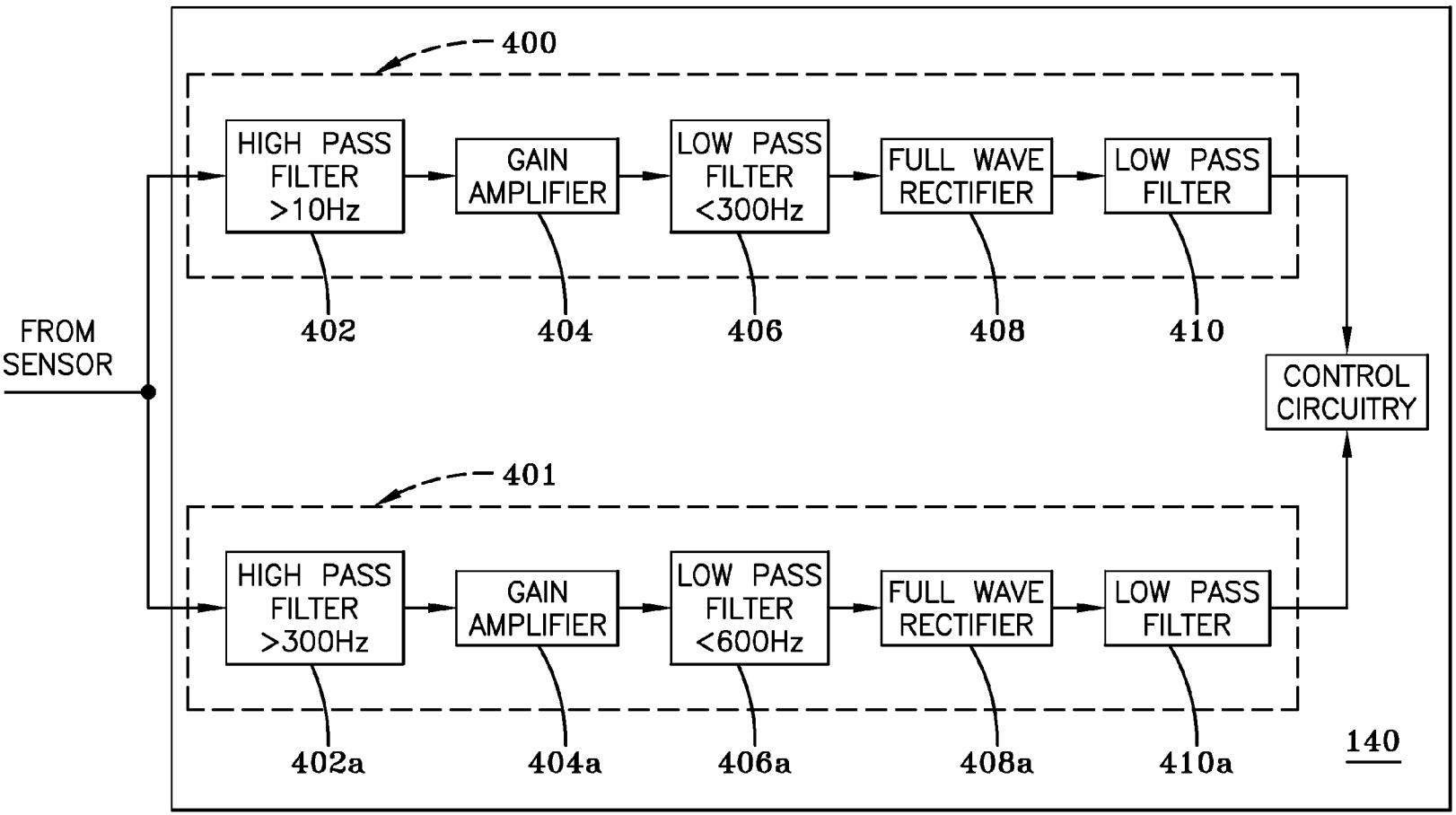
FIG. 4A illustrates schematically an alternate embodiment of an analog circuit to detect rotating stall.

FIG. 4A illustrates schematically two parallel analog circuits 400, 401. Analog circuit 400 is provided for completing steps 304-310, and analog circuit 401 is connected in parallel with analog circuit 400, for completing steps 724-730, from FIG. 7. Analog circuit 400 operates in the same manner as described above with respect to FIG. 4, for circuit elements 402 through 410. Analog circuit 401 operates in the same manner as analog circuit 400, but processes the identical input signal from the sensor 160 over a higher frequency band, as described in steps 724-730. A high pass filter 402*a* receives the signal from sensor 160, which high pass filter 402*a* filters the signal as described with regard to step 724. If necessary, a gain amplifier 404*a* can be used to boost or strengthen the output from the high pass filter 402*a*. The gain amplifier 404*a* can be used to boost the signal from the high pass filter 402*a* to an appropriate value for comparison to a threshold value representative of a rotating stall condition. A low pass filter 406*a* receives a signal from the gain amplifier 404*a* or the high pass filter 402*a* and filters the signal as described above with regard to step 726. An active full wave rectifier 408*a* is used to rectify the signal from the low pass filter 726 as described above with regard to step 728. An active full wave rectifier 408*a* is preferred in order to eliminate DC offsets that may be created by using a full wave bridge rectifier. Finally, the full wave rectified signal from the active full wave rectifier 408*a* is filtered using a low pass filter 410*a*, which filters the signal as described above with regard to step 730 and sends a signal to control circuitry, which control circuitry may include a microprocessor and/or comparator, for subsequent processing of the signal from the low pass filter 410*a*. The control circuitry then processes the signals by subtracting the output signal of low pass filter 410*a* from the output signal of low pass filter 410, as described above with regard to steps 710 and 712, and takes corrective action as described in step 314 if appropriate.

Figure 5A:
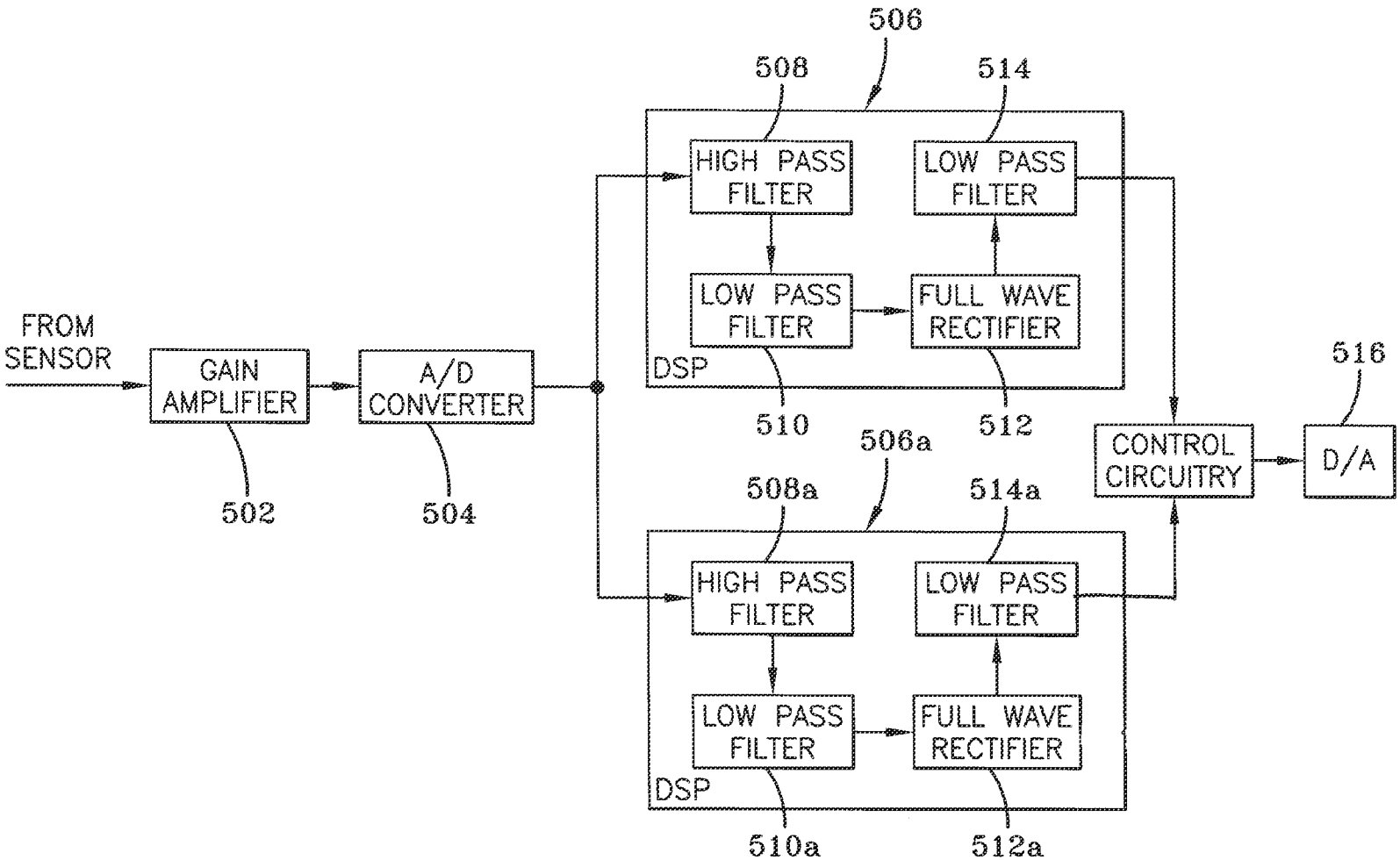
FIG. 5A illustrates schematically an alternate embodiment of a digital circuit to detect rotating stall.

FIG. 5A illustrates schematically two digital signal processors 506, 506*a* for digital implementation of the control steps shown in FIG. 7. Digital circuit 506 is provided for completing steps 304-310, and digital circuit 506*a* is connected in parallel with digital circuit 506, for completing steps 724-730, from FIG. 7. Digital circuit 506*a* operates in the same manner as described above with respect to FIG. 5, for circuit elements 502 through 514. Digital circuit 506*a* operates in the same manner as digital circuit 506, but processes the identical input signal from the sensor 160 over a higher frequency band, as described in steps 724-730. If necessary, a gain amplifier 502 can be used to boost or strengthen the signal from sensor 160 to an appropriate value for comparison to a threshold value representative of a rotating stall condition. The signal from gain amplifier 502 or the sensor 160 is then passed through an A/D converter 504 to convert the analog signal to a digital signal. The digital signal from the A/D converter 504 is then provided to digital signal processor (DSP) circuitry 506 for completing steps 724-730. In DSP circuitry 506*a*, a high pass filter 508*a* receives the signal from A/D converter 504, which high pass filter 508*a* filters the signal as described with regard to step 724. A low pass filter 510*a* receives a signal from the high pass filter 508 and filters the signal as described with regard to step 726. A full wave rectifier 512*a* is used to rectify the signal from the low pass filter 510*a* as described with regard to step 728. The full wave rectified signal from the full wave rectifier 512*a* is filtered using a low pass filter 514*a*, which filters the signal as described with regard to step 730.

Finally, the output signal of the low pass filter 514*a* of DSP circuitry 506*a* is subtracted from the signal from the low pass filter 514 of DSP circuitry 506. The digital signal representing the net difference between the higher frequency band energy and the lower frequency band energy is then passed through a D/A converter 516, which generates an analog signal and sends the analog signal to control circuitry, which may include a microprocessor and/or comparator, for subsequent processing of the analog signal.

Figure 6A:
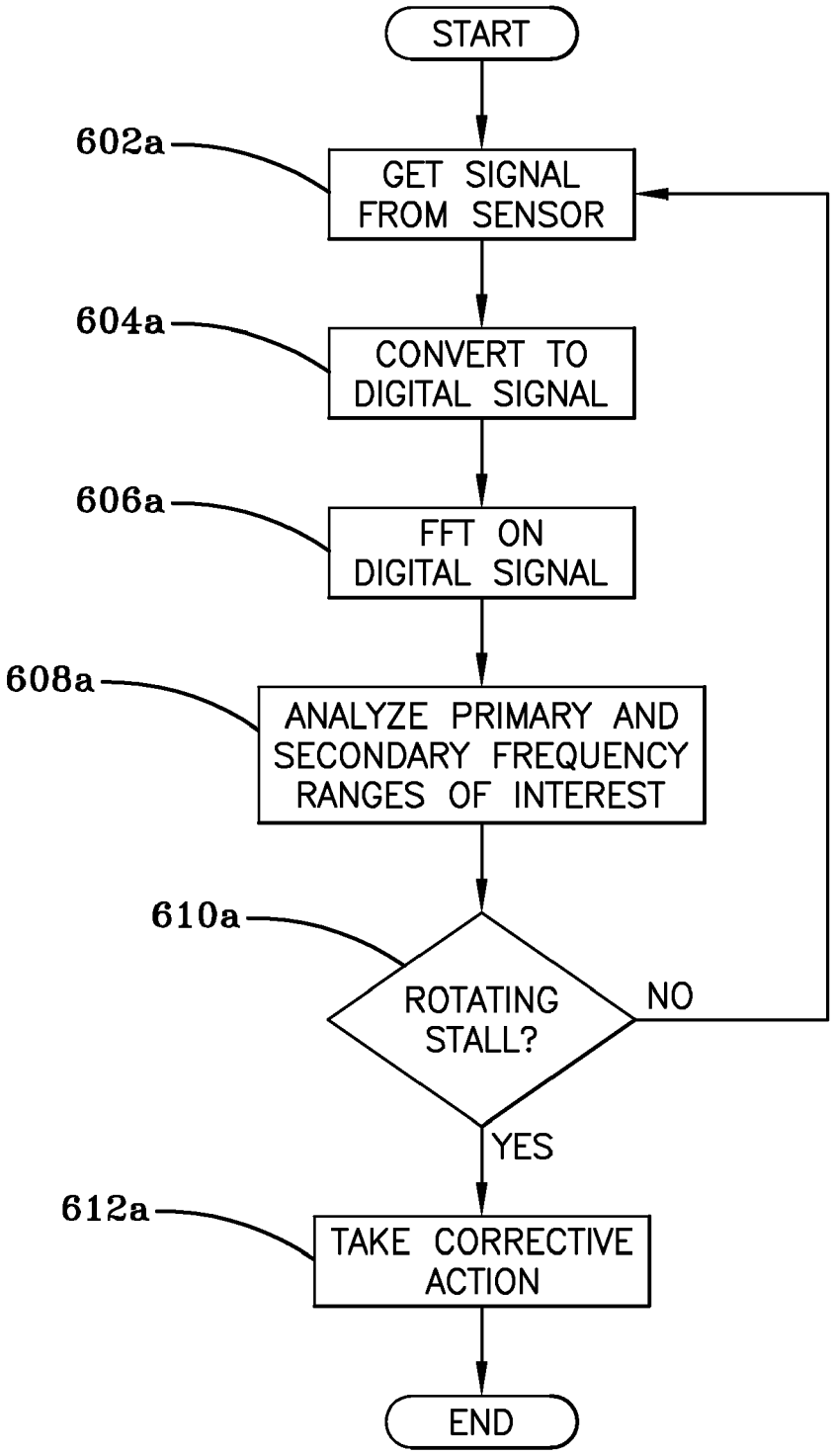
FIG. 6A illustrates a flow chart for detecting and correcting a rotating stall condition in a further embodiment.

In another embodiment, the Fast Fourier Transform (FFT) process may be modified for detecting and correcting rotating stall in the diffuser 119 of the compressor 108. Referring to FIG. 6A, in the alternate FFT embodiment, the sum of the energy that is present in the secondary frequency range—i.e., the 300-600 Hz frequency range—is determined, as is the sum of the energy presently found in the primary frequency range—i.e., 10-300 Hz frequency range. The sum of the energy that is present in the secondary range is subtracted from the sum of the energy that is found in the primary frequency range. Corrective action to move the diffuser and eliminate the rotating stall condition is controlled as described above, based on the difference between the sum of energy contained in the primary frequency range and the sum of energy contained in the secondary frequency range. When rotating stall is present, the sum of the energy in the primary frequency range is greater than the sum of the energy contained in the secondary frequency range.

Referring again to FIG. 6A, the alternative process using an FFT is described. The process begins with the control panel 140 receiving a signal from sensor 160 in step 602*a* and converting the signal from sensor 160 into a digital signal in step 604*a* using an A/D converter. Next, in step 606*a*, an FFT is applied to the digital signal from step 604*a* to generate a plurality of frequencies and energy values. The FFT can be programmed into a DSP chip on the control panel 140 and can be executed in real time. The FFT DSP chip is configured to perform any necessary operations or calculations such as multiplies and accumulations to complete the FFT. The application of an FFT to the digitized input signal from sensor 160 permits rotating stall to be detected directly in the frequency domain rather than in the time domain as described above with regard to FIG. 3.

In this alternate embodiment, two ranges of fundamental frequencies are of interest in the detection of rotating stall, approximately 10-300 Hz, and approximately 300-600 Hz as discussed in greater detail above. Those two particular ranges of frequencies of interest are analyzed in the frequency domain in step 608*a*, and frequencies outside of these respective ranges can be discarded. As indicated above, these ranges of fundamental frequencies of interest are always less than the rotating frequency of the compressor's impeller 202, thus, the analysis of rotating stall can be limited to an appropriate range of interest by considering the compressor's speed. The break frequency of 300 Hz is 90% of the fastest compressor operating speed, and thus is a preferred upper limit and rotating stall is always less than the compressor rotating speed. This limitation on the frequency range of interest is beneficial in variable speed drive (VSD) applications, since as the speed of the impeller 202 is reduced, the frequency range of interest becomes narrower and thereby aids in the elimination of extraneous frequencies which would lead to a false detection. Whether or not the compressor is operated in variable speed or fixed speed, frequency components in the FFT associated with rotating stall and its harmonics are kept, while frequency components related to the operating speed of the impeller and its harmonics are removed (set to zero). Also, other non-stall frequencies below the rotating frequency of the compressor's impeller 202 such as electrical interference (60 Hz and harmonics), which may be coupled through the transducer, are also removed.

After the elimination of extraneous frequencies in step 608*a*, the remaining components or frequencies from the FFT are then grouped according to their respective ranges (10-300 Hz as the primary frequency range of interest, and 300-600 Hz as the secondary frequency range of interest). Each discrete range is first summed to determine the total energy in the associated frequency range. The total energy in the secondary frequency range is then subtracted from the total energy in the primary frequency range, to determine if the resulting value is within the stall region in step 610*a*.

Similar to the detection of rotating stall in step 712, the detection of rotating stall in step 610*a* is based on the computed difference between the two energy parameters being greater than a threshold value that defines the stall region. The threshold value can be set to a value equal to a multiple of the normal operating value for the computed difference from the FFT components, i.e. the difference between the value of the sum of the FFT components in the primary frequency range, and the value of the sum of the FFT components in the primary frequency range, when there is no rotating stall. In one embodiment, the threshold value can be two to six times the normal operating value. The values for normal operation and threshold are dependent on the strength of the signal that is analyzed and on the amount of amplification that is applied to the signal to enhance signal to noise ratios. In another embodiment, rotating stall can be detected by determining if peaks in the remaining frequency spectrum exceed a predetermined threshold value. If rotating stall is not detected in step 610*a*, the process returns to step 602*a* and a new signal from sensor 160 is obtained for processing.

If rotating stall is detected in step 610*a*, then corrective action is taken to correct the rotating stall condition in step 612*a*. Corrective action can include, but is not limited to, narrowing the width of the diffuser space 204 of the radial diffuser 119, shortening the length of the radial diffuser 119, or increasing flow to the compressor 108 at the compressor inlet or downstream of the impeller 202. In one embodiment, upon the detection of rotating stall the control panel 140 sends a signal to the adjustment mechanism 212 of the diffuser 119 to adjust the position of the diffuser ring 210 to correct the rotating stall condition. The diffuser ring 210 is inserted into the diffuser space 204 to narrow the width of the diffuser space 204 in order to correct the rotating stall condition.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the disclosed system and method as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media which can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A method for correcting rotating stall in a radial diffuser of a compressor, the method comprising:

measuring a value representative of acoustical energy associated with rotating stall in a radial diffuser of a compressor;

filtering the measured value with a first filter to obtain a first filtered value corresponding to a first stall frequency range;

rectifying the first filtered value with a first rectifier to obtain a first rectified value;

filtering the first rectified value to obtain a first stall energy component;

filtering the measured value with a second filter to obtain a second filtered value corresponding to a second stall frequency range;

rectifying the second filtered value with a second rectifier to obtain a second rectified value;

filtering the second rectified value with a filter to obtain a second stall energy component;

subtracting the second stall energy component from the first stall energy component to obtain a differential stall energy component;

comparing the differential stall energy component to a predetermined threshold value to determine rotating stall in the compressor; and sending a control signal to adjust an operational configuration of the compressor in response to a determination of rotating stall.

2. The method of claim 1, wherein filtering the measured value with a second filter is performed concurrently with filtering the measured value with the first filter.

3. The method of claim 1, wherein the first filter comprises a bandpass filter having a first break frequency of about 10 Hz and a second break frequency of about 300 Hz.

4. The method of claim 1, wherein the second filter comprises a bandpass filter having a first break frequency of about 300 Hz and a second break frequency of about 600 Hz.

5. The method of claim 1, wherein filtering the first rectified value is performed with a low pass filter.

6. The method of claim 1, further comprising:

calculating a reference value from the first stall energy component and the second stall energy component; and determining rotating stall in the radial diffuser by comparing the reference value with a predetermined value.

7. The method of claim 1 wherein measuring a value representative of acoustical energy associated with rotating stall comprises measuring an acoustic pressure in the radial diffuser of the compressor with a pressure transducer.

8. The method of claim 7 further comprising positioning the pressure transducer in a compressor discharge passageway of the compressor.

9. The method of claim 1, wherein the step of filtering the measured value with a first filter comprises:

filtering the measured value with a first high pass filter to obtain a first intermediate value; and filtering the first intermediate value with a first low pass filter; and wherein the step of filtering the measured value with a second filter comprises:

filtering the measured value with a second high pass filter to obtain a second intermediate value; and filtering the second intermediate value with a second low pass filter.

10. The method of claim 9, wherein the first high pass filter having a break frequency of about 10 Hz and the first low pass filter having a break frequency of about 300 Hz.

11. The method of claim 10, wherein the second high pass filter having a break frequency of about 300 Hz and the second low pass filter having a break frequency of about 600 Hz.

12. The method of claim 11 further comprising amplifying each of the first intermediate value and the second intermediate value with a gain amplifier.

13. The method of claim 1, wherein at least one of the first rectifier and the second rectifier comprises a full wave rectifier.

14. The method of claim 1, wherein at least one of the first rectifier and the second rectifier comprises an active full wave rectifier.

15. The method of claim 1 wherein:

filtering the first rectified value to obtain a first stall energy component comprises filtering the first rectified value with a low pass filter having a cutoff frequency of 0.16 Hz; and filtering the second rectified value to obtain a second stall energy component comprises filtering the second rectified value with a low pass filter having a cutoff frequency of 0.16 Hz.

16. The method of claim 1 wherein the predetermined threshold value is a multiple of the reference value calculated during operation of the compressor without rotating stall.

17. The method of claim 16 wherein the predetermined threshold value is two to six times the value of the reference value calculated during operation of the compressor without rotating stall.

18. The method of claim 1 wherein sending a control signal comprises sending a control signal to control the radial diffuser.

19. The method of claim 18 further comprising adjusting a diffuser ring to narrow a width of a diffuser space in the radial diffuser in response to the control signal being sent to control the radial diffuser.

20. The method of claim 1 further comprising the step of amplifying the measured value with a gain amplifier.

21. The method of claim 1 wherein the compressor is a centrifugal compressor.

22. A method for detecting rotating stall in a compressor, the method comprising:

measuring a value representative of acoustical energy associated with rotating stall in a compressor;

performing a Fast Fourier Transform on the measured value to obtain a plurality of frequencies and corresponding energy values;

selecting a primary band of frequencies and corresponding energy values associated with rotating stall from the plurality of frequencies and energy values;

summing the corresponding energy values from the primary band of frequencies associated with rotating stall to obtain a primary rotating stall parameter;

selecting a secondary band of frequencies and corresponding energy values associated with rotating stall from the plurality of frequencies and energy values;

summing the corresponding energy values from the secondary band of selected frequencies associated with rotating stall to obtain a secondary rotating stall parameter; and calculating a differential rotating stall parameter by subtracting the secondary rotating stall parameter from the primary rotating stall parameter;

detecting rotating stall in the compressor by comparing the differential rotating stall parameter to a predetermined threshold value that defines a stall region of the compressor; and controlling a radial diffuser in response to the detection of rotating stall.

23. The method of claim 22 wherein rotating stall is present in the compressor when the differential rotating stall parameter is greater than the predetermined threshold value.

24. The method of claim 22 wherein measuring a value representative of acoustical energy associated with rotating stall comprises measuring an acoustic pressure in a radial diffuser of the compressor with a pressure transducer.

25. The method of claim 22 wherein selecting the primary band of frequencies and corresponding energy values associated with rotating stall comprises selecting frequencies and corresponding energy values in a frequency range of about 10 Hz to about 300 Hz; and selecting the secondary band of frequencies and corresponding energy values associated with rotating stall comprises selecting frequencies and corresponding energy values in a secondary frequency range of about 300 Hz to about 600 Hz.

26. The method of claim 22 further comprising removing frequencies and corresponding energy values that are not associated with rotating stall from the primary and secondary bands of frequencies.

27. The method of claim 22 wherein the predetermined threshold value is a multiple of the differential rotating stall parameter calculated during operation of the compressor without rotating stall.

28. The method of claim 22 wherein the controlling further comprises:

generating a control signal for the radial diffuser of the compressor in response to the detection of rotating stall; and sending the generated control signal to the radial diffuser to alter a configuration of the radial diffuser.

29. The method of claim 28 wherein the controlling further comprises adjusting a diffuser ring to narrow a width of a diffuser space in the radial diffuser in response to the generated control signal being sent to the radial diffuser.

30. The method of claim 22 further comprising amplifying the measured value with a gain amplifier.

31. The method of claim 22 further comprising conditioning the measured value to remove acoustical energies not associated with rotating stall.

* * * * *